US006976461B2

(12) United States Patent
Rörig et al.

(10) Patent No.: US 6,976,461 B2
(45) Date of Patent: Dec. 20, 2005

(54) FINGER LEVER OF A VALVE TRAIN OF AN INTERNAL COMBUSTION ENGINE

(75) Inventors: Bodo Rörig, Weisendorf (DE); Michael Haas, Weisendorf (DE)

(73) Assignee: Ina-Schaeffler KG, (DE)

( * ) Notice: Subject to any disclaimer, the term of this patent is extended or adjusted under 35 U.S.C. 154(b) by 0 days.

(21) Appl. No.: 11/149,620

(22) Filed: Jun. 10, 2005

(65) Prior Publication Data

US 2005/0247279 A1 Nov. 10, 2005

Related U.S. Application Data

(63) Continuation of application No. PCT/EP03/12534, filed on Nov. 11, 2003.

(30) Foreign Application Priority Data

Dec. 11, 2002 (DE) ..... 102 57 705

(51) Int. Cl.[7] ..... F01L 1/34

(52) U.S. Cl. ..... 123/90.16; 123/90.15; 123/90.2; 123/90.39; 123/90.44; 74/559; 74/568 R; 74/569

(58) Field of Search ..... 123/90.16, 90.2

(56) References Cited

U.S. PATENT DOCUMENTS 6,769,387 B2 * 8/2004 Hayman et al. ..... 123/90.39
6,923,151 B2 * 8/2005 Kreuter ..... 123/90.16

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

The invention proposes a switchable finger lever (1) for a valve train of an internal combustion engine having a compact structure. Through the inner lever (5) of the finger lever (1) it is possible, on the one hand, to realize a support on a gas exchange valve and, on the other hand, a mounting on a head of a support element. An outer lever (2) surrounds the inner lever (5) in longitudinal direction with its arms (3*a*, 3*b*) and is pivoted away from the inner lever (5) for effecting uncoupling. The outer lever (2) is mounted for pivoting on a cross axle (14) that extends through the inner element (5) axially above the support (8) for the gas exchange valve. At the same time, coupling elements (6) displaceable in cross-wise direction are arranged axially above a complementary surface (9) that serves as a support on the support element.

16 Claims, 2 Drawing Sheets

FINGER LEVER OF A VALVE TRAIN OF AN INTERNAL COMBUSTION ENGINE

This application is a continuation of PCT/EP03/012534 filed Nov. 11, 2003.

FIELD OF THE INVENTION

The invention concerns a finger lever of a valve train of an internal combustion engine, which finger lever can be switched to different lifts for at least one gas exchange valve, said finger lever comprising an outer lever and an inner lever that is arranged between arms of the outer lever, said outer and inner levers being capable of pivoting relative to each other and of being coupled together by coupling elements, so that when said outer and inner levers are coupled, a high valve lift is generated and when said levers are uncoupled, a low or zero valve lift is generated, a support for a gas exchange valve being arranged on one end of an underside of the finger lever and a complementary surface for a support element being arranged on another end of the underside of the finger lever, an upper side of the outer lever comprising at least one running surface for a high lift cam and an upper side of the inner lever comprising a running surface for a low or zero lift cam.

BACKGROUND OF THE INVENTION

A generic finger lever of the pre-cited type is known from DE 27 53 197 A1. This comprises a coupling element in the form of a latch that acts on a region under the inner lever and can be displaced by a complex linkage mechanism. Disadvantageously, the latch increases the overall height of the switchable finger lever. At the same time, the external activation through the linkage proves to be relatively complex. It is further noted that the cam running surfaces on the upper sides of the finger lever are sliding surfaces which lead to an increase of frictional work.

In other solutions relatively closely related to the species, known in the technical field for example from FIG. 1 of U.S. Pat. No. 5,544,626, the coupling mechanism is arranged above the support element and extends in longitudinal direction. This locking in longitudinal direction can likewise lead to design space problems. At the same time, the coiled compression spring disclosed, that is arranged under the switching lever and acts as a lost motion spring, also has a relatively large design space requirement in the direction of the cylinder head.

OBJECTS OF THE INVENTION

It is an object of the invention to provide a compact finger lever of the pre-cited type in which the aforesaid drawbacks are eliminated with simple measures.

This and other objects and advantages of the invention will become obvious from the following detailed description.

SUMMARY OF THE INVENTION

The invention achieves the above objects by the fact that the levers are approximately equal in length and ends of the levers do not extend substantially beyond each other, the inner lever comprises the support and the complementary surface, a cross axle extends through the inner lever above the support, the arms of the outer lever are mounted for pivoting on the cross axle, the coupling elements are positioned in the inner lever in a region above the complementary surface, and for coupling in at least one position of the levers relative to each other, the coupling elements can be displaced outwards in crosswise direction so as to extend partially in a recess of the outer lever, and a crossbar connecting the arms of the outer lever to each other extends out of the arms.

In this way, the initially mentioned drawbacks are eliminated. In particular, the invention provides a compact switchable finger lever in which friction is relatively low and whose coupling mechanism is simple to operate. Besides this, it must also be mentioned that due to the special structural design, the lever (outer lever) to be uncoupled if necessary, is situated outside and thus executes the lost motion in case of uncoupling.

On the one hand, the arms of the outer lever are retained through the crossbar at least till final assembly. On the other hand, a simple end stop is created on the inner lever for the outer lever when this returns from an uncoupling movement in the direction of the cam base circle, so that the coupling elements, after stopping has taken place, can return to their coupling position insofar as desired.

It is clear that at least one running surface of the outer lever can be contacted by a high lift cam. As a rule, however, it is advantageous to load both running surfaces through high lift cams. Similarly, it is also possible to provide only one axially outwards displaceable slide as a coupling element in the region of the complementary surface of the inner element. However, to avoid unnecessary material loading and a tendency to tilt, it is more advantageous to arrange two slides as coupling elements in the inner element, which slides can be displaced axially outwards for coupling.

It is understood that the aforesaid crossbar may also be arranged on another length section of the outer lever and be configured so that it only retains the arms of the outer lever, in which case stops can be provided elsewhere.

According to a particularly advantageous feature of the invention, the crossbar is made in one piece with the outer lever. However, it is also conceivable to configure the arms of the outer lever separately and then connect them to each other, for example, by welding them to a crossbar.

In another advantageous embodiment of the invention, only the running surface of the inner lever is configured as a rotating roller. This not only makes the finger lever less expensive but also brings design space advantages. Assuming that, statistically or empirically seen, the finger lever is operated more often in its uncoupled mode, it is a good compromise to provide a roller as a running surface only for the low lift cam that is active in the uncoupled mode.

It necessary, however, rollers may be used to form all the running surfaces or only the running surfaces of the outer lever.

The lost motion spring is preferably constituted by at least one torsion leg spring that, because of its compactness, is excellently adaptable for use in the finger lever of the invention. According to one provision of the invention, the torsion leg spring surrounds the cross axle and acts through its appropriate leg in cam direction on the outer lever. Depending on the case of use, it is also possible to use a plurality of torsion leg springs.

Further features of the invention concern the configuration and arrangement of the slides used as coupling elements. For displacement in one direction, these are advantageously supplied with hydraulic medium through the complementary surface and the inner lever. Advantageously, the hydraulic medium is routed to the complementary surface from the support element. It goes without saying, that other routing measures are also conceivable.

To put it simply, the slides acting as coupling elements can be locked or unlocked, as the case may be, in an unpressurized state. In the other direction, opposed to the hydraulic medium pressure in each case, the slides can be displaced through the force of a compression spring. However, a displacement in both directions by hydraulic medium or another servo device is also conceivable. The slides preferably have a piston-like geometry, but other configurations differing from this, for example, polygonal, spherical or similar cross-sectional shapes are also conceivable. Latches and similar coupling members are also included in the scope of protection, so that, in place of the bore for the slides, polygonal cross-sections etc. with a preferably complementary shape to the slides may also be used.

Finally, it is proposed to make the levers out of a light-weight material such as, for example, sheet metal. In the case of sheet metal, a stamping-plus-bending method is favored.

The invention will now be described more closely with reference to the appended drawing.

DETAILED DESCRIPTION OF THE DRAWING

Figure 1:
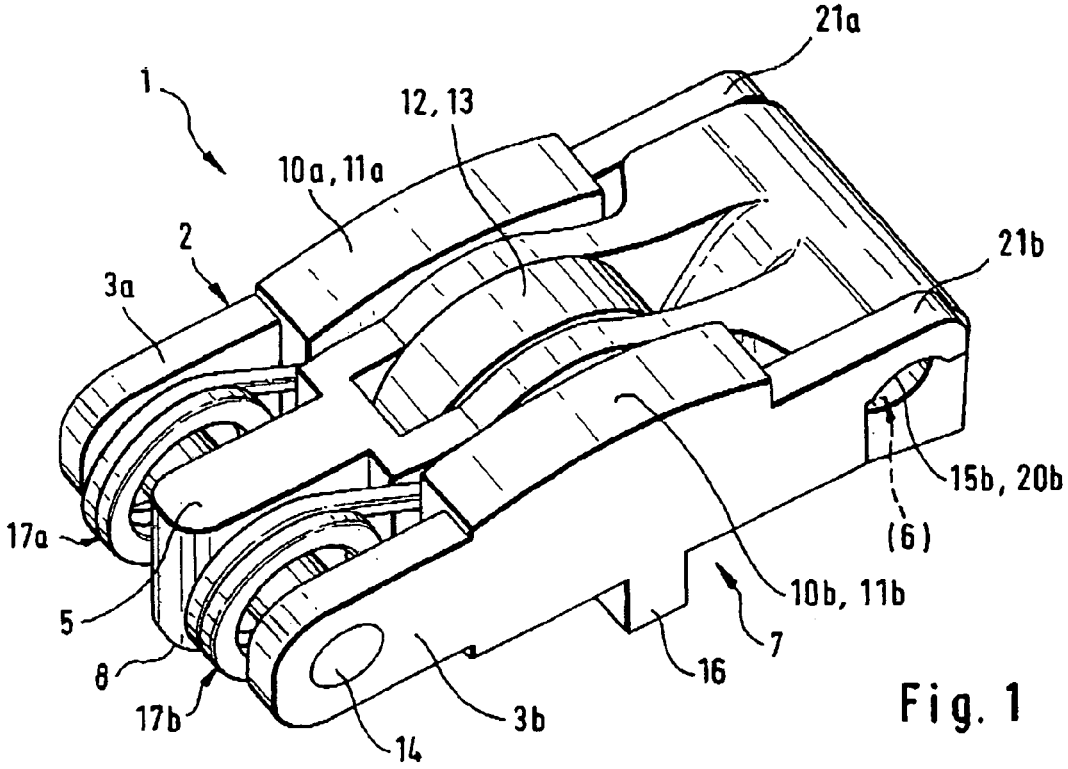
FIG. 1 is a three-dimensional illustration of a finger lever of the invention.

FIG. 1 discloses a switchable finger lever 1 comprising two parallel arms 3*a*, 3*b* that form an outer lever 2. On their underside 7, the arms 3*a*, 3*b* are connected by a crossbar 16.

An inner lever 5 having approximately the same length as the arms 3*a*, 3*b* extends between these arms. A stop for the outer lever 2 on the inner lever 5 in cam direction is formed by the crossbar 16. On one end, the inner lever 5 comprises a support 8 (see also FIG. 2) for activating a gas exchange valve. On the opposite end, a complementary surface 9, in the present case a concave cavity, is formed in the underside 7 for a head of a support element. Thus, the finger lever 1 is mounted through the complementary surface 7 on said head. However, it is also possible to use a pivot axis for mounting the finger lever 1 (oscillating lever) in this region.

As shown in FIG. 1, upper sides 10*a* 10*b* of the arms 3*a*, 3*b* comprise running surfaces 11*a*, 11*b* configured as sliding surfaces for high lift cams. The Inner lever 5, in contrast, comprises on its upper side 12, a rotating roller that forms the running surface 13. The cam in this case is a low or zero lift cam.

Figure 2:
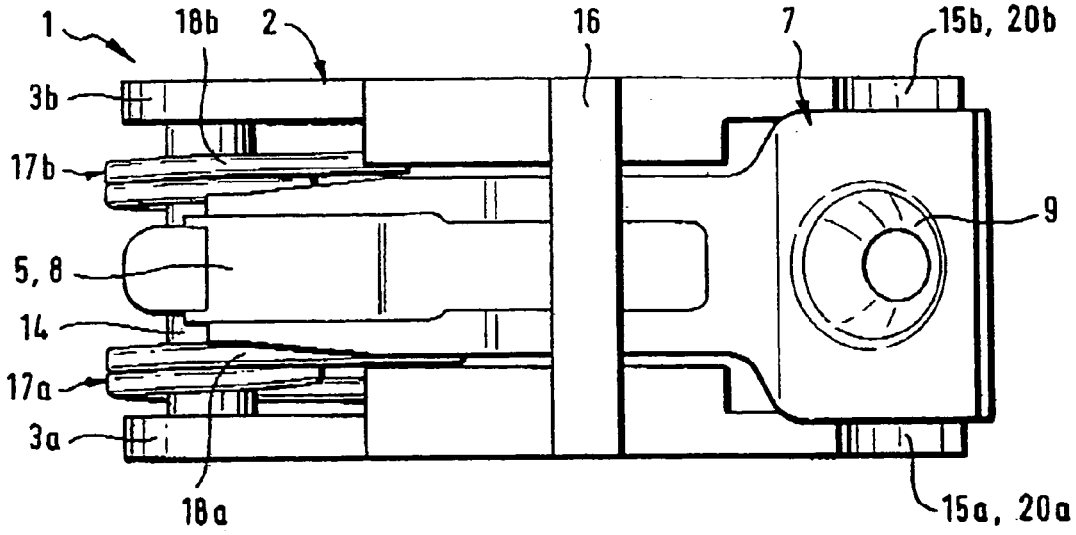
FIG. 2 is a bottom view of the finger lever of FIG. 1.
Figure 3:
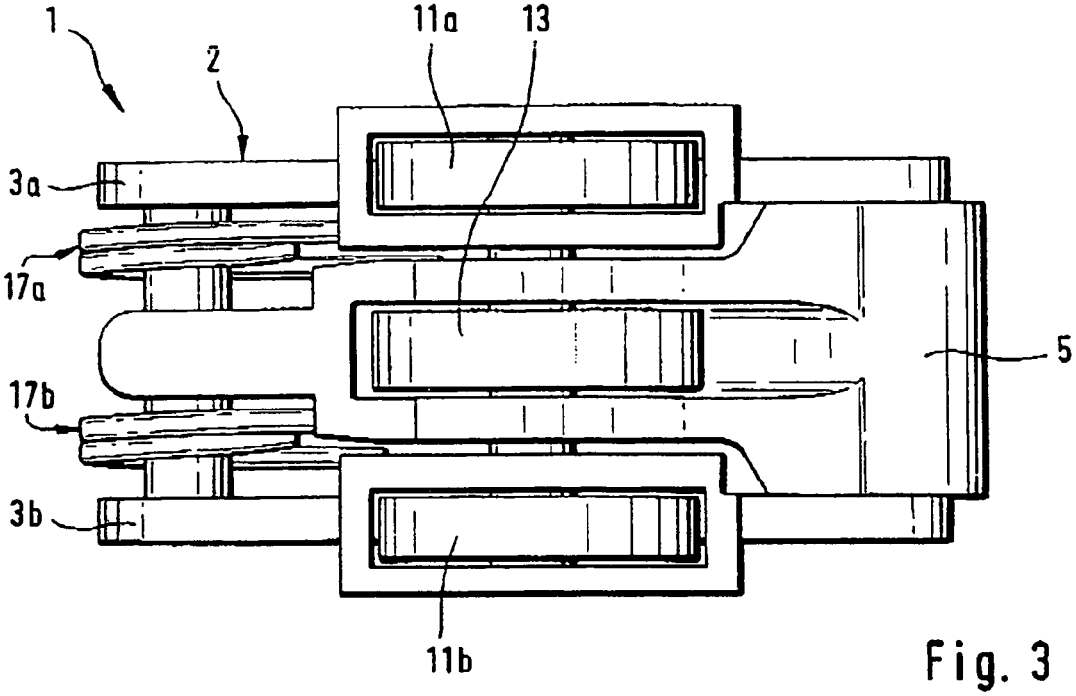
FIG. 3 is a top view of the finger lever of FIG. 1.

A person skilled in the art will further see from FIGS. 1 to 3 that a cross axle 14 is arranged in the region of the support 8. This cross axle 14 extends directly through a bore of the inner lever 5 more or less above the support 8 (other designs are also conceivable). Between the arms 3*a*, 3*b* and the inner lever 5 there is sufficient remaining place in this region on the cross axle 14 for arranging two torsion leg springs 17*a*, 17*b*. Each torsion leg spring 17*a*, 17*b* engages with one leg 18*a*, 18*b* under the respective arm 3*a*, 3*b* of the outer lever 2, and acts as a lost motion springs. For special cases of use, however, it is conceivable and intended to also use coiled compression springs and the like.

Figure 4:
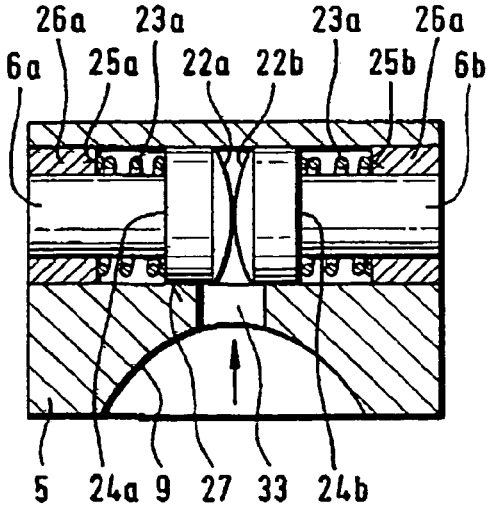
FIG. 4 is a cross-sectional view through the finger lever of the invention in a region of a complementary surface.
Figure 5:
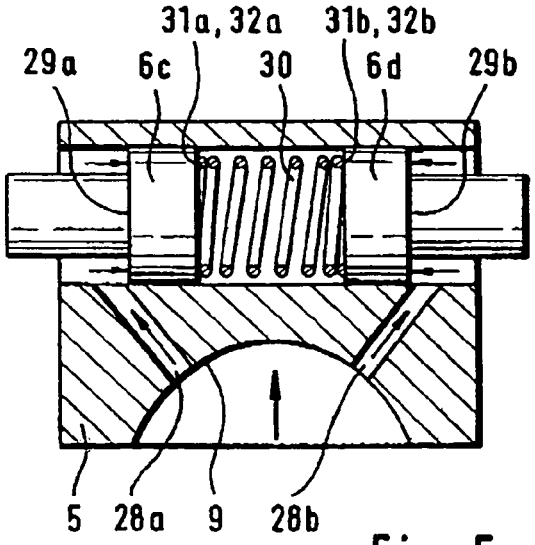
FIG. 5 is a cross-sectional view through another embodiment of the finger lever of the invention in a region of the complementary surface.

Above the complementary surface 9, or at least in its vicinity, a crosswise extending bore 27 is arranged in the inner lever 5 (best seen in FIGS. 4 and 5). For uncoupling, two opposing coupling elements 6*a*, 6*b* (FIG. 4) or 6*c*, 6*d* (FIG. 5) configured as piston-like slides extend entirely in this bore 27.

According to FIG. 4, the slides 6*a*, 6*b* are displaced in their coupling direction by hydraulic medium. This can be routed from the head of the support element, not illustrated, and further through a supply duct 33 arranged in the inner lever 5, directly to end faces 22*a*, 22*b* of the slides 6*a*, 6*b*. In the presence of sufficient hydraulic medium pressure, the slides 6*a*, 6*b* are displaced partially into a corresponding recess 15*a*, 15*b* of the opposing arm 3*a*, 3*b*. A re-positioning of the slides 6*a*, 6*b* is effected through the force of compression springs 23*a*, 23*b* which advantageously surround the slides 6*a*, 6*b* and act axially inwards on annular shoulders 24*a*, 24*b* of the slides 6*a*, 6*b* while being supported axially outwards on inner annular surfaces 25*a*, 25*b* of separate sleeves 26*a*, 26*b*.

In the embodiment of FIG. 5, a displacement of the slides 6*c*, 6*d* in their coupling direction is realized through the force of at least one compression spring 30. A re-setting is effected in this case through hydraulic medium that, again, can be routed from the head of the support element through the complementary surface 9 and the inner lever 5 to outer end faces 29*a*, 29*b* of the slides 6*c*, 6*d*.

As can be seen particularly in FIG. 1, the recesses 15*a*, 15*b* for the coupling elements 6 must not necessarily be made as a bore. It is also possible to provide a finger-like extension 21*a*, 21*b* on the upper sides 10*a*, 10*b* of the arms 3*a*, 3*b* at their support element ends. These extensions 21*a*, 21*b* comprise on their undersides 20*a*, 20*b* circular segment-shaped recesses 15*a*, 15*b*.

A person skilled in the art will further see from FIG. 3 that even the running surfaces 11*a*, 11*b* of the arms may comprise rollers. In this case, it is conceivable and intended to configure the running surface 13 of the inner lever 5 as a sliding surface.

Many different measures are conceivable for adjusting the coupling lash but will not be discussed here in detail. For example, it is possible, on the one hand, to group a diameter of the rollers. On the other hand, the coupling elements 6 may be grouped or a grouping may be effected on the basis of the outer lever 2.

What is claimed is:

1. A finger lever of a valve train of an internal combustion engine, which finger lever can be switched to different lifts for at least one gas exchange valve, said finger lever comprising an outer lever and an inner lever that is arranged between arms of the outer lever, said outer and inner levers being capable of pivoting relative to each other and of being coupled together by coupling elements, so that when said outer and inner levers are coupled, a high valve lift is generated and when said levers are uncoupled, a low or zero valve lift is generated, a support for a gas exchange valve being arranged on one end of an underside of the finger lever and a complementary surface for a support element being arranged on another end of the underside of the finger lever, an upper side of the outer lever comprising at least one running surface for a high lift cam and an upper side of the inner lever comprising a running surface for a low or zero lift cam, wherein said levers are approximately equal in length and ends of the levers do not extend substantially beyond each other, the inner lever comprises the support and the complementary surface, a cross axle extends through the inner lever above the support, the arms of the outer lever are mounted for pivoting on the cross axle, the coupling elements are positioned in the inner lever in a region above the complementary surface, and for coupling in at least one position of the levers relative to each other, the coupling elements can be displaced outwards in crosswise direction so as to extend partially in a recess of the outer lever, and a crossbar connecting the arms of the outer lever to each other extends out of the arms.

2. A finger lever of claim 1, wherein the crossbar is arranged approximately in a region of a central transverse plane on the underside, and, for coupling, the crossbar forms a stop for the outer lever on the inner lever.

3. A finger lever of claim 2, wherein the crossbar is made in one piece with the arms.

4. A finger lever of claim 1, wherein the running surface of the inner lever is configured as a rotating roller and the at least one running surface of the outer lever is configured as a sliding surface.

5. A finger lever of claim 1, wherein the running surfaces of the inner and the outer lever are configured as rotating rollers.

6. A finger lever of claim 1, wherein the running surface of the inner lever is configured as a sliding surface and the at least one running surface of the outer lever is configured as a rotating roller.

7. A finger lever of claim 1, wherein the cross axle is surrounded at least on one side axially between the inner and the outer lever by a torsion leg spring constituting a lost motion spring, one leg of said spring acting in cam direction on the adjacent arm of the outer lever.

8. A finger lever of claim 1, wherein the coupling elements are constituted by two slides arranged in the inner lever and, for coupling, these slides can be displaced away from each other partially into respective recesses in the arms of the outer lever.

9. A finger lever of claim 1, wherein said recesses of the outer lever are configured on an underside of a finger-like end extension of the upper side of the arms of the outer lever and have a circular segment-like shape which engages over an upper side of the respective coupling element.

10. A finger lever of claim 8, wherein said recesses of the outer lever are configured on an underside of a finger-like end extension of the upper side of the arms of the outer lever and have a circular segment-like shape which engages over an upper side of the respective slide.

11. A finger lever of claim 8, wherein a displacement of the slides for effecting coupling is realized through a servo means that can be routed to a point directly in front of opposing inner end faces of the slides through a supply duct in the inner lever starting from the complementary surface, and a displacement of the slides for effecting uncoupling is realized through a loading means.

12. A finger lever of claim 11, wherein the loading means comprises compression springs configured as at least one coiled spring surrounding each slide, which compression springs act axially inwards on an annular shoulder of the slide and bear axially outwards against an inner annular surface of a sleeve that is fixed in a bore of the inner lever for the slides.

13. A finger lever of claim 8, wherein a displacement of the slides for effecting uncoupling is realized through a servo means that can be routed to a point directly in front of axially outer end faces of the slides through two supply ducts in the inner lever starting from the complementary surface, and a displacement of the slides for effecting coupling is realized through a loading means.

14. A finger lever of claim 1, wherein at least one of the inner and the outer levers is made at least substantially of a light-weight material.

15. A finger lever of claim 14, wherein the light-weight material is one of a deer drawn sheet metal or a sheet metal capable of being deep-drawn.

16. A finger lever of claim 14, wherein the light-weight material is one of a plastic or a fiber-reinforced plastic.

* * * * *